US006155849A

United States Patent [19]

Kodama et al.

[11] Patent Number: 6,155,849

[45] Date of Patent: Dec. 5, 2000

[54] CONNECTOR COUPLING DEVICE

[75] Inventors: Shinji Kodama; Hiroshi Watanabe; Hideto Kumakura; Kiyohito Fukuda; Nobuyuki Akeda, all of Shizuoka, Japan

[73] Assignee: Yazaki Corporation, Tokyo, Japan

[21] Appl. No.: 09/158,525

[22] Filed: Sep. 22, 1998

[30] Foreign Application Priority Data

Sep. 24, 1997 [JP] Japan ..... 9-258328
Jan. 22, 1998 [JP] Japan ..... 10-010649

[51] Int. Cl.[7] ..... H01R 13/62

[52] U.S. Cl. ..... 439/157; 439/347

[58] Field of Search ..... 439/157, 347, 439/152, 153, 154, 155, 159, 160, 296, 299, 345, 346, 368, 370, 374, 544, 571, 376, 310

[56] References Cited

U.S. PATENT DOCUMENTS 5,921,791 7/1999 Ono et al. ..... 439/157

FOREIGN PATENT DOCUMENTS 5-114436 5/1993 Japan ..... H01R 13/629
8-241756 9/1996 Japan ..... H01R 13/631
9-17508 7/1997 Japan ..... H01R 13/64

*Primary Examiner*—Paula Bradley
*Assistant Examiner*—Ross Gushi
*Attorney, Agent, or Firm*—Sughrue, Mion, Zinn, Macpeak & Seas, PLLC

[57] ABSTRACT

A connector coupling device comprises a first connector in which a slide plate having a cam groove is provided being capable of sliding so as to traverse the first connector, a second connector having a fitting projection which is engaged with the cam groove for coupling the second connector with the first connector when the slide plate is slid toward a first direction, and which is removed from the cam groove for removing the second connector from the first connector when the slide plate is slid toward a second direction opposed to the first direction, a coupling case having a first opening into which the first connector is inserted and a second opening into which the second connector is inserted and slidablly mounted therein, and a fitting support member urging one end portion of the slide plate toward the first direction while the first connector is pushed toward the second connector inside of the case in a third direction perpendicular to the first and second directions for coupling the first connector with the second connector.

3 Claims, 15 Drawing Sheets

1
2
3
6
6'
7'
8
8a
8b
9
9a
9b
22
22a
22b
41
51
51a
51b
52
53a
53b
53c
C
L'

CONNECTOR COUPLING DEVICE

BACKGROUND OF THE INVENTION

1. Field of the Invention

The present invention relates to a connector coupling device which couples one connector provided on the electronic equipment side to the other connector provided on the side of a case such as an instrument panel for storing the electronic equipment therein.

The present invention is based on Japanese Patent Application Nos. Hei 9-258328 and Hei 10-10644, which are incorporated herein by reference.

2. Description of the Related Art

In Unexamined Japanese Patent Publication No. Hei 8-241756, there is disclosed such a connector coupling device as shown in FIG. 16.

In FIG. 16, reference character 31 designates electronic equipment and 32 stands for a case for storing the electronic equipment 31 therein, while, when the electronic equipment 31 is stored into the case 32, the former is pushed from the front surface of the latter.

On the bottom surface of the electronic equipment 31, there is disposed one connector 33 to be coupled and, on the bottom wall 37 of the case, there is mounted the other connector 34 to be coupled at a position opposed to the connector 33. If these two connectors 33 and 34 are fitted with each other, then an electric wire 35 is connected to the electronic equipment 31. By the way, reference character 36 designates an adapter for guidance, that is, when the connector 33 is fitted with the connector 34, the adapter 36 guides the connector 33 for alignment with the connector 34, thereby facilitating their mutual fitting engagement.

In the conventional connector coupling device, by pushing the electronic equipment 31 toward the connector 34 mounted on the case side, the connector 34 on the case side and the connector 33 on the electronic equipment side are coupled together.

In such coupling method, since a force applied when the electronic equipment 31 is pushed in, that is, a force necessary for storage of the electronic equipment 31 and fitting engagement between the connectors is wholly transmitted to the connector 34 mounted on the case side, there is a possibility that the case 32 or the connector 34 mounted on the case side can be deformed or damaged, thereby making it impossible to couple the two connectors 33 and 34 together smoothly. For this reason, in coupling together multi-terminal connectors each having a large number of connecting terminals, the case must be structured such that it is stronger than necessary for protection of the electronic equipment.

Also, conventionally, there is also proposed such a connector coupling device as shown in FIGS. 17 and 18, which is disclosed in Unexamined Japanese Patent Publication No. Hei 9-17508.

This conventional connector coupling device is a device in which a slide plate 92 is slidablly stored within one connector 91 and, by means of insertion and removal of the slide plate 92, one connector 91 can be fitted with and removed from the other connector 93 with a low insertion/removal force.

However, in this conventional connector coupling device, there is a fear that the slide plate 92, which has been projected from one connector 91 before the two connectors 91 and 93 are fitted with each other, can be contacted or entangled with an electric wire or other parts (not shown) while the coupling device is being delivered; that is, due to such contact or entanglement, the slide plate 92 itself, one connector 91 or the other connector 93 can be broken. Also, when lock mechanisms (not shown) are respectively provided in the two connectors 91 and 93 in order to prevent the slide plate 92 from being removed from one connector 91, the two connectors 91 and 93 are complicated in structure, so that the manufacturing cost of a forming metal mold (not shown) becomes high. Further, for example, when means for prevention of wrong insertion is formed in one connector 91 (or the other connector 93) which is to be inserted into an equipment mounting opening (not shown) formed in the instrument panel, there arises an inconvenience that the connector (91 or 93) itself becomes bulky in shape.

SUMMARY OF THE INVENTION

In view of the above circumstances of the conventional connector coupling devices, it is an object of the invention to provide a connector coupling device which can couple connectors together accurately and smoothly without increasing the strength of a case such as an instrument panel or the like for storing electronic equipment therein.

It is another object of the invention to provide a connector coupling device which prevents the slide plate from projecting out from the connector prior to mutual fitting engagement between the two connectors and also prevents the wrong insertion of the connector into the equipment mounting opening.

In order to the above object, there is provided a connector coupling device comprising: a first connector in which a slide plate having a cam groove is provided being capable of sliding so as to traverse the first connector; a second connector having a fitting projection which is engaged with the cam groove for coupling the second connector with the first connector when the slide plate is slid toward a first direction, and which is removed from the cam groove for removing the second connector from the first connector when the slide plate is slid toward a second direction opposed to the first direction; a coupling case having a first opening into which the first connector is inserted and a second opening into which the second connector is inserted and slidablly mounted therein; and a fitting support member urging one end portion of the slide plate toward the first direction while the first connector is pushed toward the second connector inside of the case in a third direction perpendicular to the first and second directions for coupling the first connector with the second connector. The fitting support member is one inner side wall of the coupling case being inclined toward the first direction and abutting against the one end portion of the slide plate while the first connector is pushed toward the third direction.

If the first connector is inserted into the coupling case, then the slide plate is urged and slid by the inclined inner wall, due to the sliding motion of the slide plate, the fitting projection of the second connector is pulled in along the cam groove of the slide plate toward the first connector, so that the two connectors can be coupled together. This eliminates the possibility that the force used when mounting the electronic equipment can be applied directly to the coupling case, which in turn avoids the need to increase the strength of the case itself specially. Thanks to this, not only the case or connectors can be prevented against breakage but also the two connectors can be fittingly engaged with each other accurately and smoothly.

In the device, the first connector includes a recess and the slide plate includes a projection engaging with the recess when the coupling of the first connector and the second connector is completed. When the two connectors are fittingly engaged with each other, the projection is engaged with the recess to thereby generate an engaging sound. Due to the thus generated engaging sound, it is possible to confirm that the two connectors are fittingly engaged with each other perfectly. That is, it is possible to prevent the incomplete engagement of the two connectors.

In the device, the first connector includes a securing member securing with the first opening after the projection engages with the recess.

Since the securing member is secured with the first opening of the coupling case after the projection is engaged with the recess, it is possible to inform an operator of the completion of the connectors mutual engagement, thereby preventing the half or incomplete connectors mutual engagement.

In the device, a handle portion is provided at the one end portion of the slide plate for pulling the slide plate toward the second direction.

Therefore, when removing the fitting engagement between the two connectors, by gripping the handle portion, the slide plate can be pulled out easily, so that the fitting engagement between the two connectors can be removed.

According to the present invention, the device may further include a removal support member urging the slide toward the second while the first connector is pulled from the second connector inside of the coupling case in a fourth direction opposed to the third direction for removing the first connector from the second connector. The removal support member is the other inner side wall of the coupling case being inclined toward the second direction and abutting against the other end portion of the slide plate while the first connector is pulled toward the fourth direction.

When removing the first connector, since the other inclined inner side wall allows the slide plate to slide in the opposite direction at the time of insertion, then the mutual engagement between the two connectors can be removed automatically.

In the device, the slide plate may be in a form of parallelogram in which the one end portion is inclined toward the first direction and the other end portion is inclined toward the second direction, here, the fitting support member is one side edge of the first opening abutting against the one end portion of the slide plate while the first connector is pushed toward the third direction, and the removal support member is the other side edge of the first opening abutting against the other end portion of the slide plate while the first connector is pulled toward the fourth direction.

Since the both inclined end portions of the slide plate is abutted and slid by the side edges of the first opening, it is not necessary to provide the inclined inner side walls inside of the coupling case, which not only can simplify the interior structure of the coupling case but also can reduce the size of the first opening (especially, the width of the slide plate in the sliding direction thereof). As a result of this, the whole of the connector coupling device can be reduced in size and weight.

In the device, the coupling case may include a fitting groove provided on one of inner side walls thereof, the fitting groove extending in the third and fourth directions and being curved toward the first direction, and the slide plate may include a protrusion engaging with the slide groove, here, the fitting support member is an outer side wall of the fitting groove abutting against the protrusion of the slide plate while the first connector is pushed toward the third direction, and the removal support member is an inner side wall of the fitting groove abutting against the protrusion of the slide plate while the first connector is pulled toward the fourth direction. Therefore, due to the sliding motion of the protrusion of the slide plate along the fitting groove, the slide plate is slid. And due to the slide movement of the slide plate, the engagement and removal between one connector and the other connector can be carried out.

In the device, the coupling case may include a slide groove provided on one of side walls, the slide groove extending in the third and fourth directions and being curved toward the second direction, and the slide plate may include a protrusion engaging with the slide groove, here, the fitting support member is an outer side wall of the fitting groove abutting against the protrusion of the slide plate while the second connector is pushed toward the fourth direction, and the removal support member is an inner side wall of the fitting groove abutting against the protrusion of the slide plate while the second connector is pulled toward the third direction.

The first connector may include grooved portion extending in a direction perpendicular to the sliding direction of the slide plate through the first connector such that section thereof is substantially U-shape, and the fitting groove may be formed so as to across the one side wall of the coupling case from inside to outside thereof, here, the grooved portion of the first connector is capable of accommodating the slide plate and that portion of the fitting groove disposed inside of the coupling case.

Accordingly, because the slide plate is situated within the grooved portion of the first connector before the first connector is set within the coupling case, there is eliminated the possibility that the slide plate can be projected out from the first connector.

In the device, that portion of the fitting groove exposed to outside of the coupling case may be utilized as a detection member for detecting a wrong coupling of the coupling case and an exterior equipment.

In the device, the coupling case includes a provisional retaining member for provisionally retaining the second connector when the first connector is separated from the second connector.

The provisional retaining member is a elastic arm having a protrusion engaging provisionally with a recess formed on the second connector, the protrusion is positioned at a start point of the coupling of the first connector and the second connector.

Since the recess is formed in the second connector and the elastic arm including the protrusion is provided in the coupling case, when the first connector is held in a separated state, the second connector can be locked to and held by the coupling case.

In the device, a front end of the first connector spreads the elastic arm outwards to release the provisional retaining of the second connector when the first connector is pushed toward the third direction to couple with the second connector.

Accordingly, it is possible to turn the second connector easily from the fixedly held state thereof into the slidable state thereof.

DETAILED DESCRIPTION OF THE PREFERRED EMBODIMENTS

Figure 1:
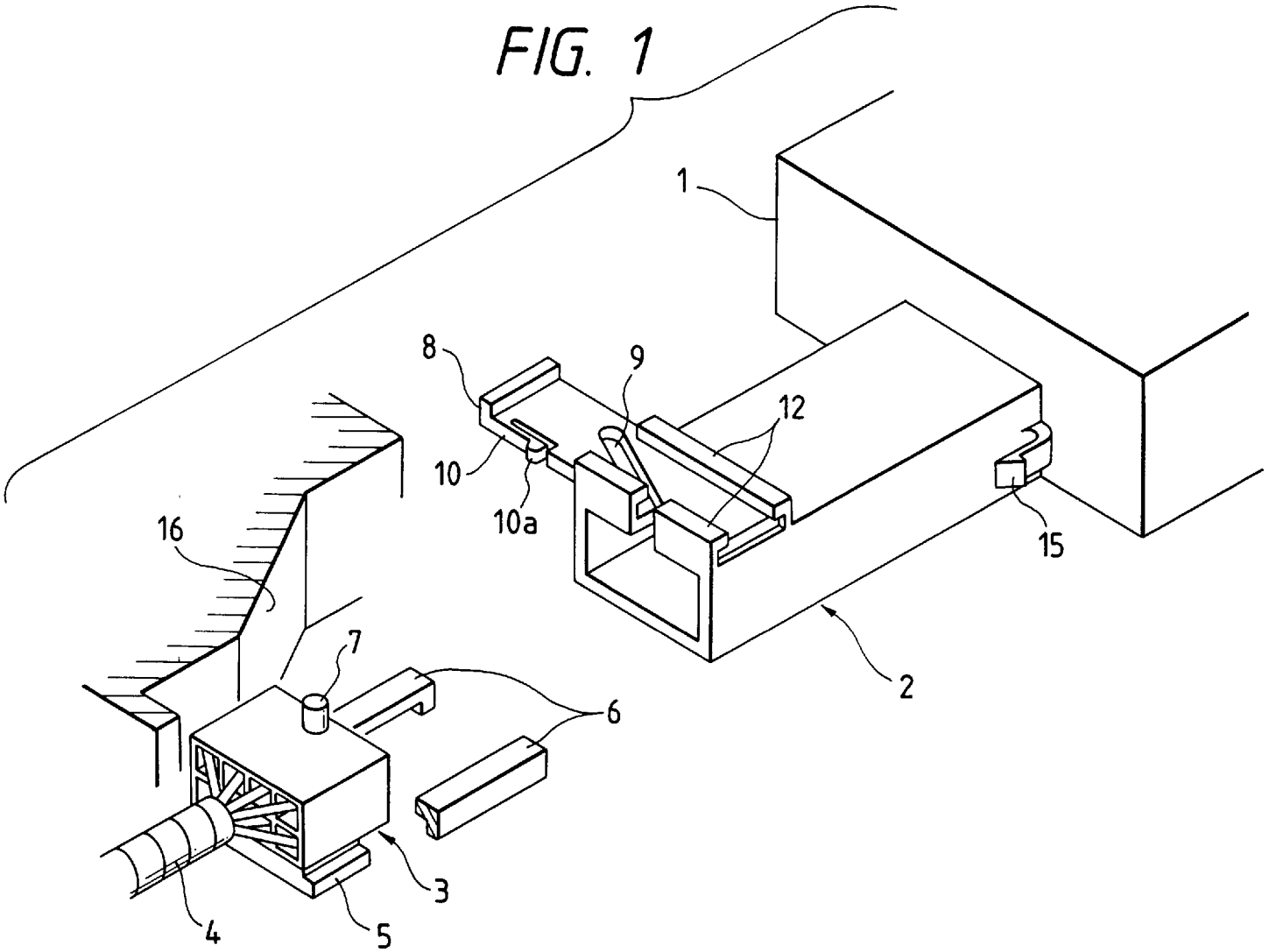
FIG. 1 is an exploded perspective view of a first embodiment of a connector coupling device according to the present invention.
Figure 2:
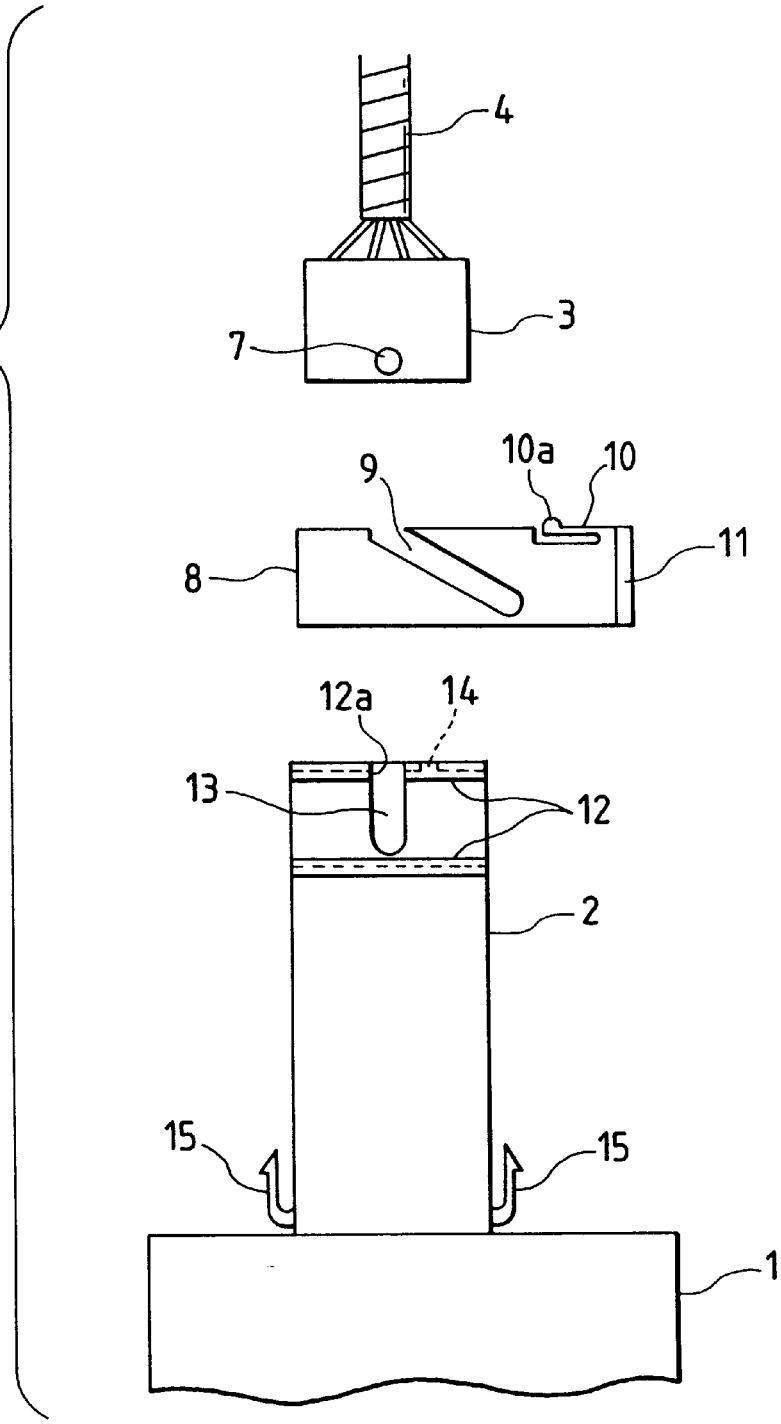
FIG. 2 is a plan view of one connector 2, the other connector 3 and a slide plate 8 respectively shown in FIG. 1.

Now, description will be given below of a first embodiment of a connector coupling device according to the present invention with reference to FIGS. 1 to 3. In particular, FIG. 1 is a perspective view of the first embodiment of a connector coupling device according to the present invention, showing a state thereof in which components thereof are separated; FIG. 2 is a plan view of one connector 2, the other connector 3, and a slide plate 8 respectively shown in FIG. 1; and, FIGS. 3 (*a*) to (*c*) are respectively explanatory views of steps of coupling the two connectors 2 and 3 together.

Figure 3C:
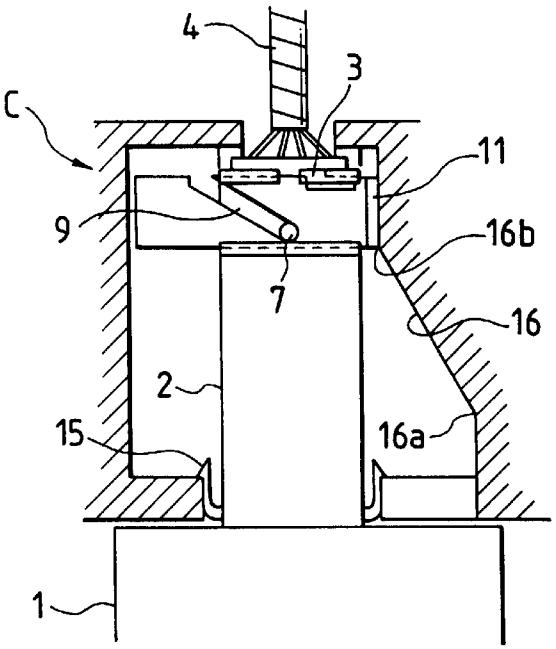
FIGS. 3(*a*) to (*c*) show a process for coupling the two connectors 2 and 3 shown in FIG. 1 to each other; in particular, FIG. 3 (*a*) shows a state thereof when the coupling operation of the connectors 2 and 3 is started, FIG. 3 (*b*) shows a state thereof while the coupling operation is being executed, and FIG. 3 (*c*) shows a state thereof when the coupling operation is completed.
Figure 3B:
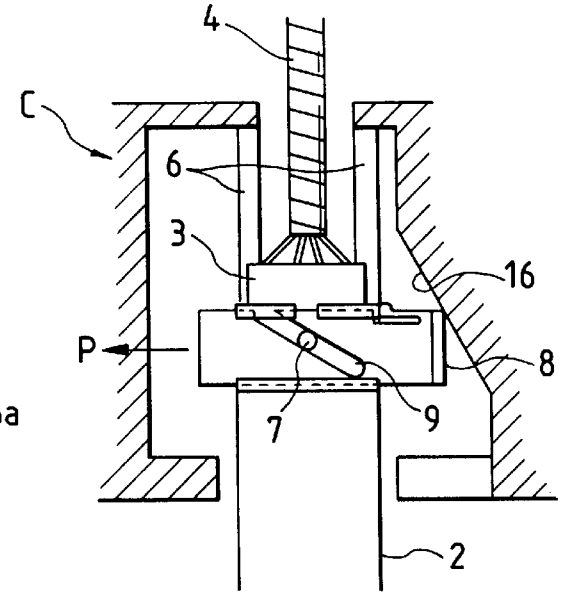
Figure 3A:
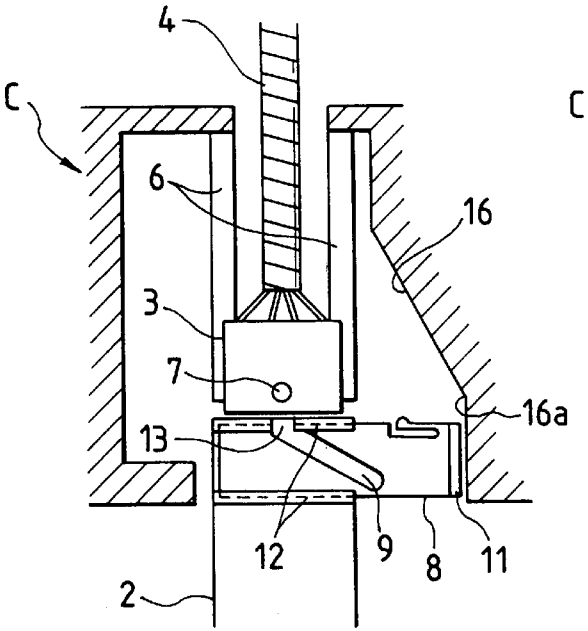

In FIGS. 1 to 3, reference character 1 designates electronic equipment such as a gauge board, a control switch unit or the like, 2 stands for one connector mounted on the electronic equipment 1, and 3 expresses the other (mating) connector connected to the terminal of a wire harness (electric wires) 4.

The connector 3 includes two slide projection strips 5 which respectively project out on the two sides of the lower surface thereof, and also the connector 3 is structured such that, while being guided by two guide walls 6 respectively provided in a case C, it can be slid in the insertion and removal direction of the electronic equipment 1. Also, the connector 3 further includes a fitting projection 7 which is provided in the front portion of the upper side wall thereof.

The slide plate 8 is a rectangular plate and, in the connector 2, there are mutually opposing guide walls 12 along which the slide plate 8 can be slid in a direction perpendicular to the insertion and removal direction of the electronic equipment 1.

Referring in detail to the structure of the slide plate 8, as shown in FIG. 2, on one side thereof, there is formed a cam groove (or slit) 9 which is inclined with respect to the equipment insertion and removal direction and is engageable with the fitting projection 7 of the connector 3; on the other side thereof, there are disposed not only a flexible arm 10 including a confirmation projection 10*a* used to confirm the fitting engagement between the two connectors 2 and 3 but also, in the end portion thereof, a removal handle 11 which is used to pull out the slide plate 8.

Also, in the connector 2, as shown in FIG. 2, there is formed a guide groove 13 which extends in parallel to the connector insertion and removal direction and is used to slide the fitting projection 7 of the connector 3 therein. In the front guide wall 12, there are formed not only a passage 12*a* for the fitting projection 7 but also a recess 14 which can be engaged with the confirmation projection 10*a* of the slide plate 8 on completion of fitting engagement between the two connectors 2 and 3.

And, reference character 15 designates securing arms which are used to secure the electronic equipment 1 to the case C or the like. 16 stands for a fitting inclined wall provided on the inner wall surface of the case C or the like, which, when the electronic equipment 1 is inserted into the case C, can be slidingly contacted with the slide plate 8 to press against the slide plate 8, thereby causing the slide plate 8 to slide in a direction perpendicular to the insertion direction of the electronic equipment 1.

Next, description will be given below of the fitting engagement between the two connectors 2 and 3.

At first, as shown in FIG. 3 (*a*), the connector 3 connected to the wire harness 4 is fitted with the guide walls 6 provided in the case C and is then slid toward the entrance side of the case C, so that the connector 3 is set in the leading end portion 16*a* of the fitting inclined wall 16. On the other hand, the slide plate 8 is moved by an operator gripping the removal handle 11 and is thus set at a position where the opening end of the cam groove 9 of the slide plate 8 is opposed to the fitting projection 7.

In this state, if the electronic equipment 1 is pushed into the case C, then the fitting projection 7 of the connector 3 is firstly engaged with the cam groove 9 of the slide plate 8; and, if the electronic equipment 1 is pushed in further, then, as shown in FIG. 3 (*b*), the slide plate 8 is pressed by the fitting inclined wall 16 and is thereby slid in a direction of an arrow P. Due to this, while the connector 3 on the wire harness 4 side is retreating, the fitting projection 7 of the connector 3 is pulled in along the cam groove 9 and guide groove 13 towards the connector 2, so that the two connectors 2 and 3 can be fittingly engaged with each other.

If the electronic equipment 1 is pushed in still further, then, as shown in FIG. 3 (*c*), the slide plate 8 reaches the terminal end portion 16*b* of the fitting inclined wall 16, thereby completing the fitting engagement between the two connectors 2 and 3. Also, on completion of the fitting engagement between the two connectors 2 and 3, the confirmation projection 10*a* of the slide plate 8, which has been described in connection with FIG. 2, is engaged with the recess 14 of the guide wall 12 of the connector 2 to thereby produce an engagement sound, which makes it possible for an operator to confirm the completion of the fitting engagement between the two connectors 2 and 3.

By the way, if the engagement between the confirmation projection 10*a* and recess 14 is carried out prior to completion of the engagement between the securing arm 15 shown in FIG. 2 and securing member (not shown) provided in the case C, then it is possible not only to inform the operator of the completion of the fitting engagement between the two connectors 2 and 3 but also to eliminate the possibility of incurring half or insufficient fitting engagement between the two connectors 2 and 3.

On the other hand, to remove the fitting engagement between the two connectors 2 and 3, in the state shown in FIG. 3 (*c*), the electronic equipment 1 may be pulled out externally of the case C. However, in this state, the fitting projection 7 is still situated in the deepest end portion of the cam groove 9 and thus the two connectors 2 and 3 are also still in fitting engagement with each other. Accordingly, if the operator grips the removal handle 11 and pulls out the same (in the opposite direction to the above-mentioned arrow P direction) by hand, then there is obtained the state shown in FIG. 3 (*b*), thereby being able to remove the fitting engagement between the two connectors 2 and 3.

Figure 4C:
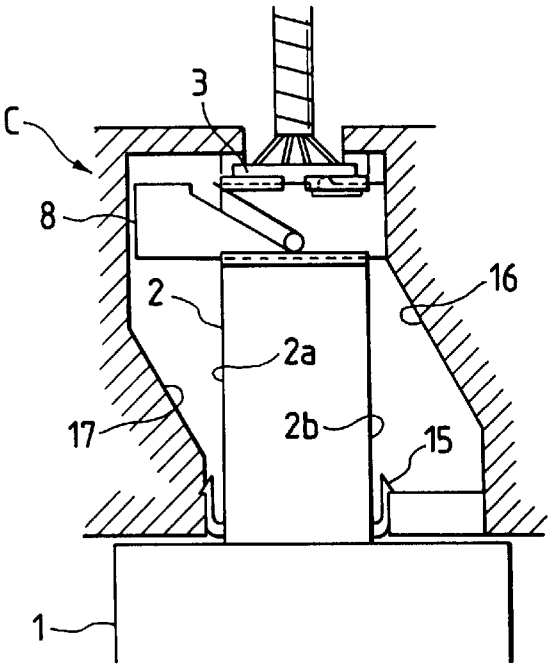
FIGS. 4 (*a*) to (*c*) are respectively explanatory views of the structure and coupling operation of a second embodiment of a connector coupling device according to the present invention.
Figure 4B:
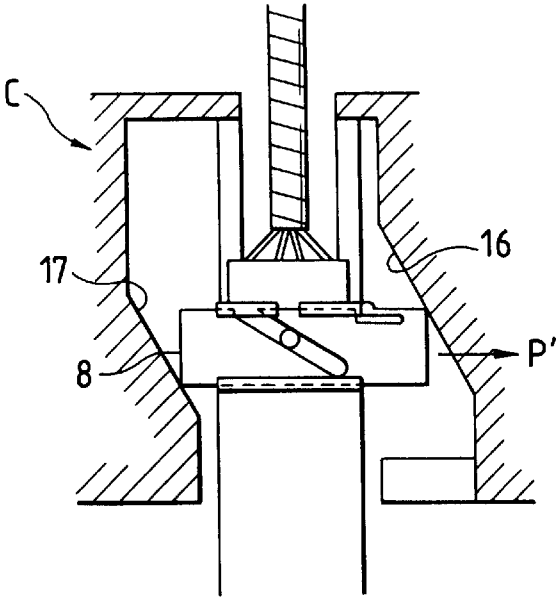
Figure 4A:
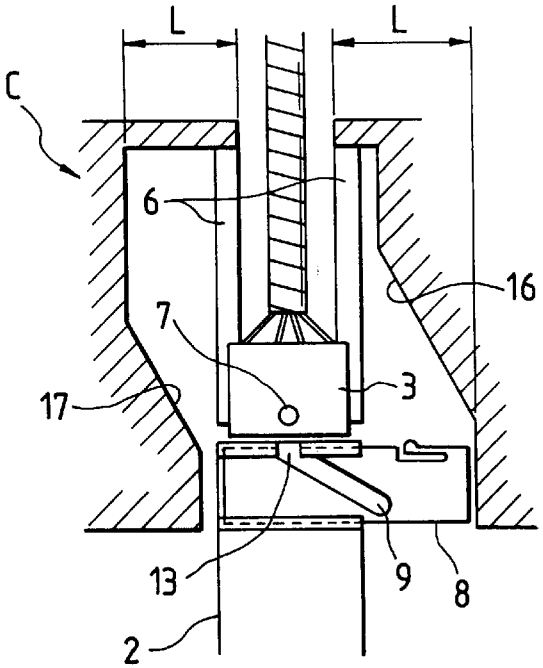

Now, FIGS. 4 (*a*) to (*c*) are respectively explanatory views of the structure and connector coupling process of a second embodiment of a connector coupling device according to the present invention.

In the first embodiment, to remove the fitting engagement between the two connectors 2 and 3, the operator grips by hand the removal handle 11 provided on the end side of the slide plate 8 and pulls out the slide plate 8 in the above-mentioned manner. On the other hand, in the second embodiment, the slide plate 8 can be pulled out automatically.

In FIG. 4, in the inner wall of the case C, there is formed a removal inclined wall 17 which is disposed opposed to and extends in parallel to the above-mentioned fitting inclined wall 16.

Due to provision of such removal inclined wall 17, in a state shown in FIG. 4 (*c*) where the two connectors 2 and 3 are fittingly engaged with each other, if the electronic equipment 1 is pulled out from the case C, then, as shown in FIG. 4 (*b*), the slide plate 8 is pressed by the removal inclined wall 17 and is thereby slid towards right side in the figure (arrow P' direction opposed to the arrow P direction), so that the two connectors 2 and 3 can be gradually separated from each other.

Figure 5:
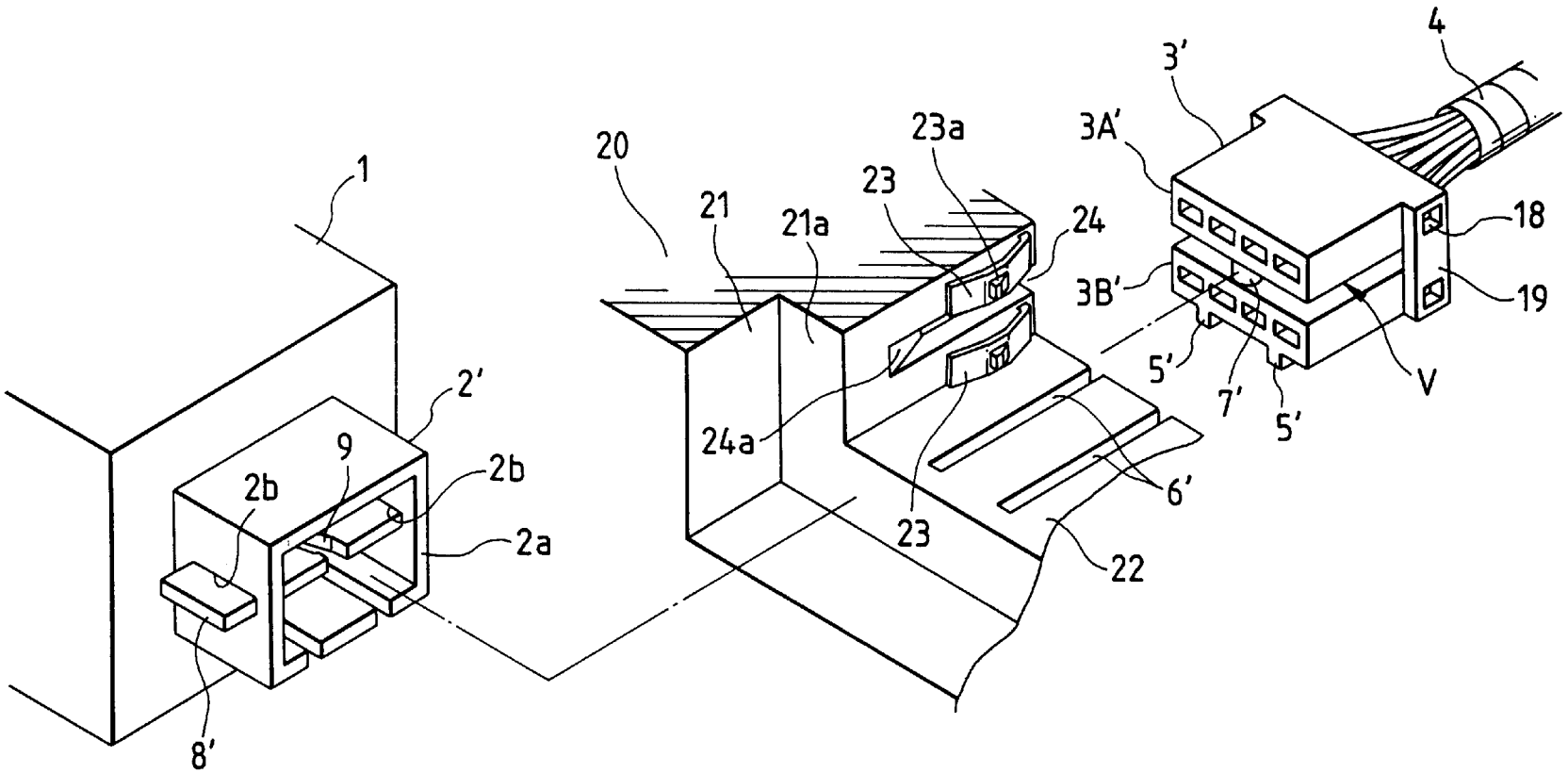
FIG. 5 is an exploded perspective view of a third embodiment of a connector coupling device according to the present invention.

Now, FIG. 5 shows an exploded perspective view of a third embodiment of a connector coupling device according to the present invention. In the third embodiment, there is shown a concrete case in which electronic equipment such as a meter, a switch or the like for use in a vehicle is mounted on an instrument panel 20. In the present embodiment, components thereof, which are different in shape from those employed in the first embodiment and shown in FIGS. 1 to 3 but are similar in function to them, are given the same designations with dashes (') applied thereto.

The third embodiment is different from the first embodiment in the following respect. In the first embodiment, there is provided no member for holding or locking the connector 3 disposed in the case side. In contrast, in the third embodiment, there is provided such a holding member.

That is, as shown in FIG. 5, the connector 3' includes in the rear end portion of each of the two side walls thereof a holding frame 19 on which securing holes 18 are formed.

In the equipment mounting opening 21 of the instrument panel 20, there is formed a connector mounting opening 22 through a stepped portion 21*a*. And, in the upper and lower portions of inner faces of both side walls of the connector mounting opening 22, there are provided securing arms 23 which respectively include securing projections 23*a*. In the middle of the inner faces of the side walls, there are formed slide plate guide grooves 24 one of which includes a removal inclined wall 24*a* formed in the front portion thereof (whereas the other slide plate guide groove 24 formed on the opposed side of the shown slide plate guide groove 24 includes a similar fitting inclined wall to FIGS. 1 and 4); and, in inner face of lower wall of the connector mounting opening 22, there are formed two connector guide grooves 6'.

By the way, the stepped portion 21*a* is used as a stopper wall when the electronic equipment 1 is mounted into the equipment mounting opening 21 of the instrument panel 20.

In the connector 3' provided on the wire harness 4 side, there are formed two terminal chamber portions 3A' and 3B' in such a manner that they are divided in the vertical direction by a fitting projection 7' provided in the front center portion of the connector 3'. On the lower face of the lower terminal chamber portion 3B', there are provided two slide projection strips 5' which can be engaged with the above-mentioned connector guide grooves 6' respectively. In the front portion of the connector 2' disposed on the electronic equipment 1 side, there is provided a hood 2*a* in an extended manner. A slide plate 8' having a cam groove 9 crosses the central portion of the hood 2*a* and is slidablly supported by two support openings 2*b* respectively formed in both side walls of the hood 2*a*. In this case, the slide plate 8' can be moved horizontally within a space V formed between the upper and lower terminal chamber portions 3A' and 3B' of the connector 3'.

In the present embodiment, if the connector 3' on the wire harness 4 side is inserted into the connector mounting opening 22 from the interior side of the instrument panel 20, then the slide projection strips 5' are moved forward while they are being guided by the connector guide grooves 6'. And when the slide projection strips 5' reach the front ends of the connector guide grooves 6' respectively, they are stopped there and the securing projections 23*a* of the securing arms 23 are engaged with the securing holes 18 of the connector 3', so that the connector 3' is held or locked.

In this state, if the electronic equipment 1 is pushed into the instrument panel 20, then the hood 2*a* of the connector 2' is pressed against the leading end portions of the securing arms 23 to thereby spread out the securing arms 23 by force. Then, if the electronic equipment 1 is pushed in further, then not only the fitting projection 7' is engaged with the cam groove 9 but also the hood 2*a* is inserted between the securing projections 23*a* and the securing holes 18, thereby removing the engagement between the connector 3' and securing arms 23.

After then, by means of a similar mechanism to the mechanism which has been previously described in connection with the second embodiment shown in FIG. 4, the slide plate 8' is engaged with the fitting inclined wall (not shown) or removal inclined wall 24*a* in the slide plate guide groove 24, so that the two connectors 2' and 3' can be fittingly engaged with each other or the engagement between them can be removed.

With use of the third embodiment, similarly to the second embodiment, since the rectangular-shaped slide plate 8' is moved horizontally, it is necessary to set the width of the connector mounting opening 22 equal to or larger than the sum of the width of the connector 2' and the moving width of the slide plate 8', which results in the large-sized structure.

Figure 6:
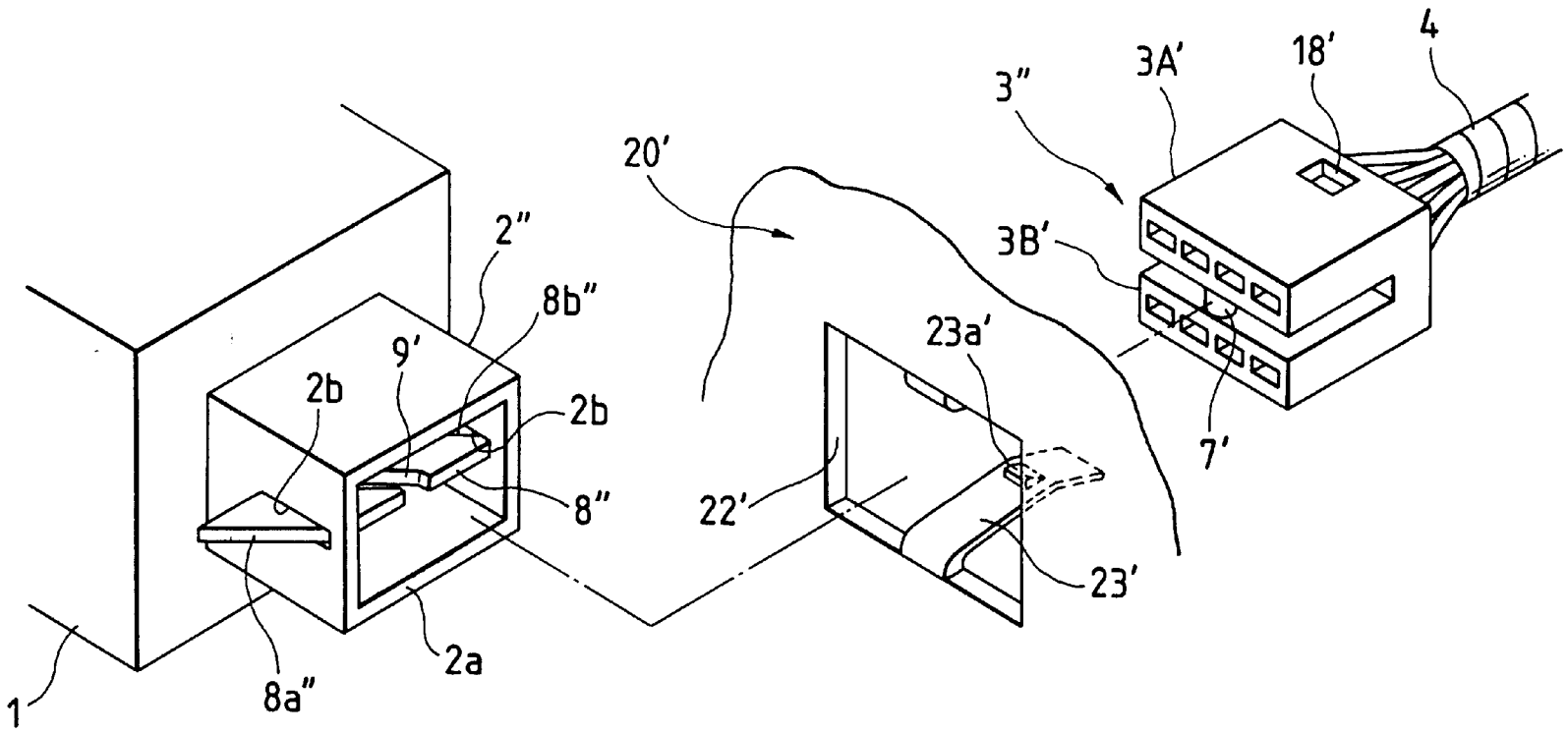
FIG. 6 is an exploded perspective view of a fourth embodiment of a connector coupling device according to the present invention.

Now, in FIG. 6, there is shown a fourth embodiment which is improved in this respect. A connector 3" disposed on the wire harness 4 side is a modified version of the connector 3'. In particular, similar to the connector 3', there are formed two terminal chamber portions 3A' and 3B' in such a manner that they are divided in the vertical direction by a fitting projection 7' formed in the front center portion of the connector 3". Differently from the connector 3', there are formed securing holes 18' in the respective rear end portions of the upper and lower faces of the connector 3".

In correspondence to the connector 3", the connector mounting opening 22' of the instrument panel 20 is formed slightly larger than the connector 3" both in the longitudinal and transverse widths thereof, that is, the connector mounting opening 22' is so formed as to have dimensions that allow the connector 2" on the electronic equipment 1 side to advance and retreat therethrough. And, in the upper and lower inner edges of the connector mounting opening 22', there are disposed two securing arms 23' each including a securing projection 23*a'*.

On the other hand, referring to the structure of a connector 2" disposed on the electronic equipment 1 side, similarly to the third embodiment, a slide plate 8" including a cam groove 9' is mounted on two support openings 2*b* respectively formed on the two sides of the hood 2*a* in such a manner that the slide plate 8" can be slid horizontally. Differently from the third embodiment, the slide plate 8" is formed as a parallelogram in which the both sides are composed of mutually parallel inclined sides, that is, one (in FIG. 6, shown on this side) of them is a fitting inclined end 8*a*", while the other is a removing inclined end 8*b*".

Next, description will be given below of the fitting engagement and removal between the connector 2", which is disposed on the electronic equipment 1 side and also in which the slide plate 8" is mounted, and the connector 3" disposed on the wire harness 4 side with reference to FIGS. 7 (*a*) to (*c*).

Figure 7A:
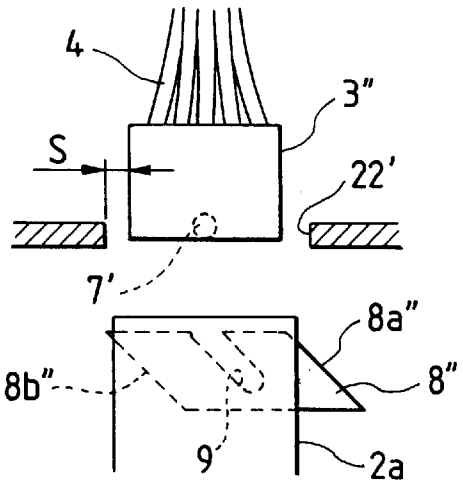
FIGS. 7 (*a*) to (*c*) are respectively explanatory views of the operation of the connector coupling device shown in FIG. 6.
Figure 7B:
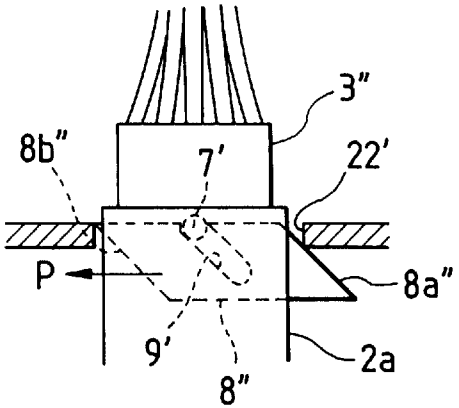
Figure 7C:
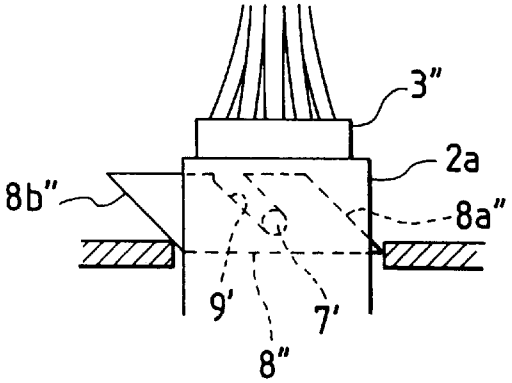

At first, as shown in FIG. 7 (*a*), the connector 3" is inserted from interior side of the connector mounting opening 22' to bring the securing projections 23*a*' of the securing arms 23' into engagement with the securing holes 18', thereby locking and fixing the connector 3" to the connector mounting opening 22'. As shown in FIG. 7 (*a*), between the connector 3" and the connector mounting opening 22', there is provided a clearance S which allows the connector 2" to pass through the connector opening 22'.

On the other hand, the hood 2*a* of the connector 2" is held in a state where the fitting inclined end 8*a*" of the slide plate 8" is projected out externally of the hood 2*a* while the removal inclined end 8*b*" on the opposite side thereof is stored almost completely in the interior of the hood 2*a*.

In this state, as shown in FIG. 7 (*b*), if the electronic equipment 1, namely, the connector 2", is inserted, then, similarly to the third embodiment, the leading end of the hood 2*a* of the connector 2" is pressed against the respective leading end portions of the securing arms 23' to spread the same by force and advance further, so that the fitting projection 7' of the connector 3" is engaged with the cam groove 9' of the slide plate 8". And, if the electronic equipment 1 is inserted further, then, similarly to the third embodiment, not only the locking between the securing arms 23' and connector 3" is removed but also the fitting inclined end 8*a*" of the slide plate 8" is contacted with one edge of the connector mounting opening 22' and is moved in the arrow P direction, so that the connector 3" is pulled toward the connector 2" side.

And, as shown in FIG. 7 (*c*), if the electronic equipment 1 is inserted until the fitting inclined end 8*a*" of the slide plate 8" is substantially moved into and stored in the hood 2*a*, then the fitting projection 7' reaches the terminal end of the cam groove 9', thereby completing the fitting engagement between the two connectors 2" and 3". At the then time, the terminal end portion of the removal inclined end 8*b*", which has been moved to the outside of the hood 2*a* from the opposite side, is in contact with the other edge of the connector mounting opening 22'. Therefore, if the electronic equipment 1 is pulled out, then the fitting engagement between the two connectors 2" and 3" can be removed due to the removal inclined end 8*b*", in particular, due to the reversed version of the above-mentioned operation of the removal inclined end 8*b*".

As described above, according to the fourth embodiment, since the slide plate 8" is formed as a parallelogram in which the both sides are respectively composed of the fitting inclined end 8*a*" and removal inclined end 8*b*", the connector mounting opening 22' formed on the instrument panel 20 side can be so formed as to have a small dimension substantially equal to the dimension of the connector 2".

Figure 8:
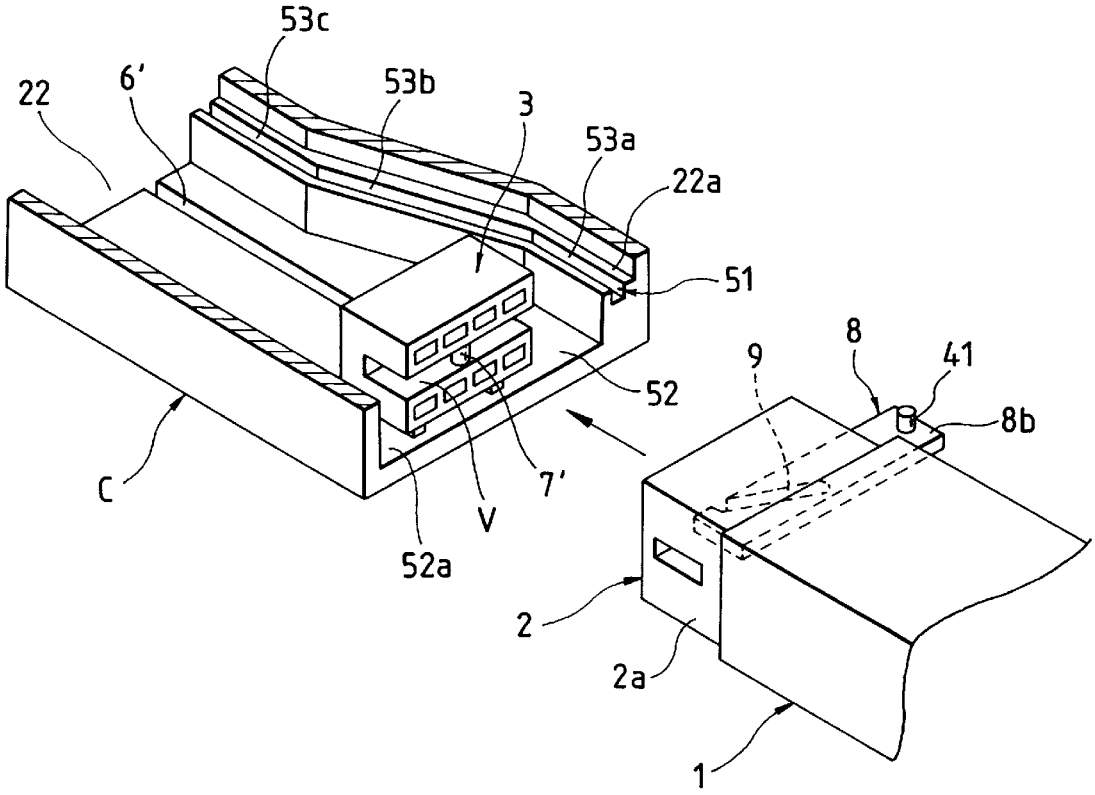
FIG. 8 is an exploded perspective view of a fifth embodiment of a connector coupling device according to the present invention.
Figures 9A, 9B, 9C:
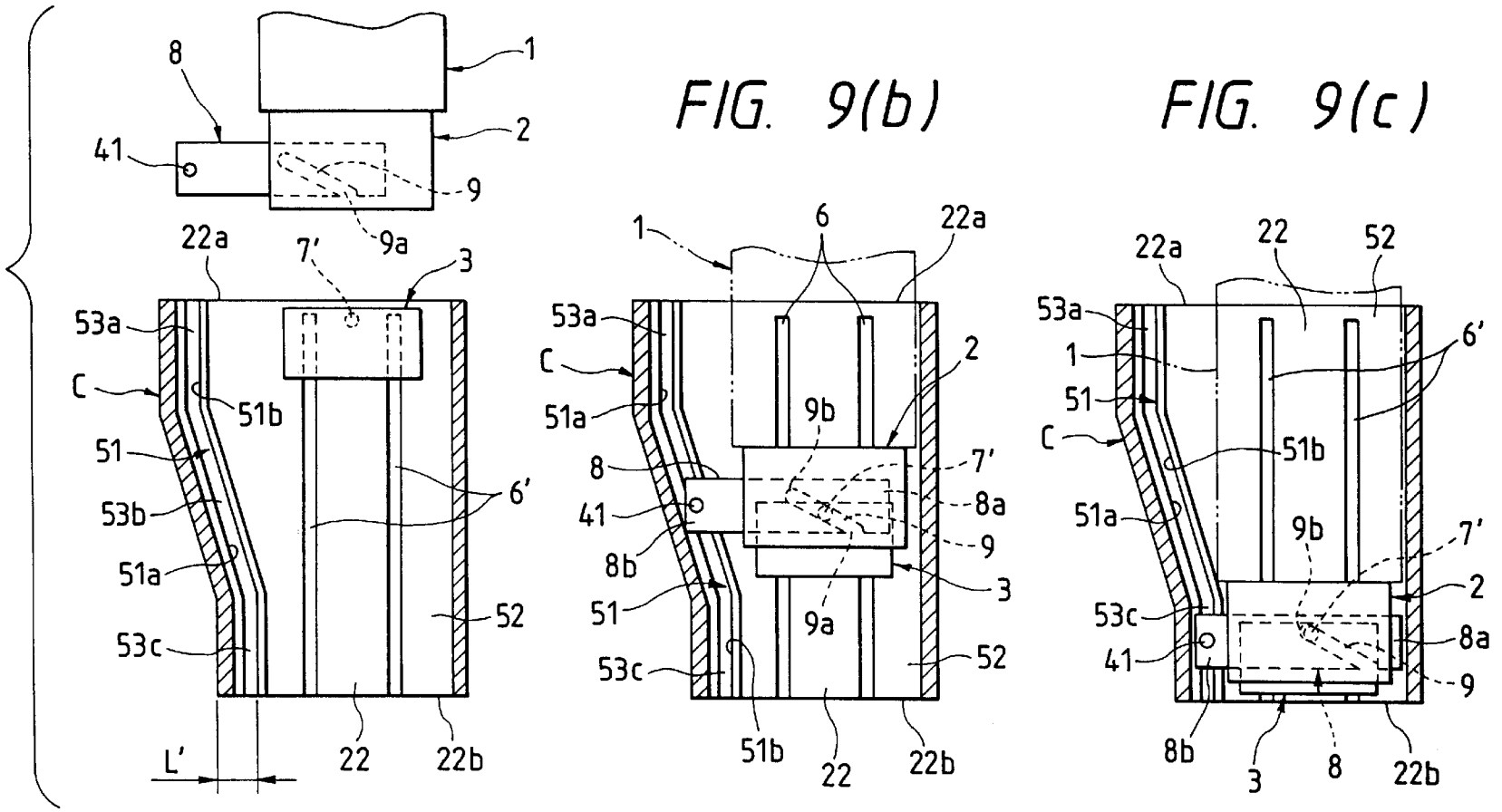
FIGS. 9 (*a*) to (*c*) are respectively explanatory views of the operation of the connector coupling device shown in FIG. 8.
Figure 10A:
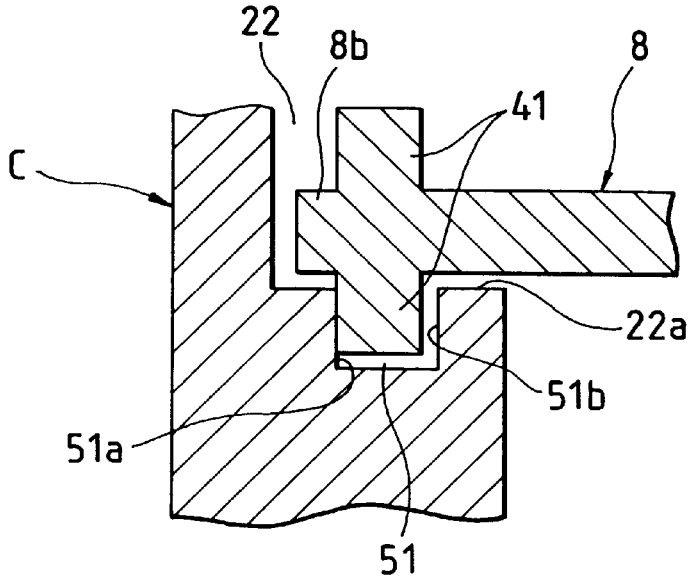
FIG. 10 (*a*) shows the relation between the bosses and fitting side wall, and FIG. 10 (*b*) shows the relation between the bosses and removal side wall.
Figure 10B:
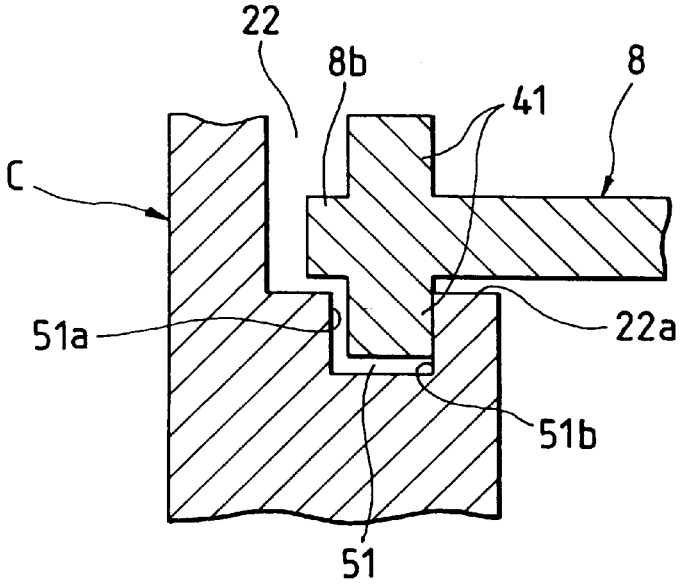

Now, FIGS. 8 to 10 are respectively explanatory views of the structure and coupling process of a fifth embodiment of a connector coupling device according to the present invention. By the way, in the fifth embodiment, like components thereof as in the first to third embodiments are given the same designations and numerals and thus the detailed description thereof is omitted here.

In the second embodiment, when the slide plate 8 is projected out from the wall of one connector 2 within the case C after the two connectors 2 and 3 are fittingly engaged with each other and removed from each other, the projection length of the slide plate 8 is substantially the same whether it is projected from the left wall 2*a* or right wall 2*b* of the connector 2 (see FIG. 4). On the other hand, in the fifth embodiment, projection length of the slide plate 8 from the connector 2 is different according to the projection direction thereof (see FIG. 8).

In FIG. 8, the present connector coupling device is a device in which bosses 41 are provided in the right end portion 8*b* of the slide plate 8 and a sliding groove 51 corresponding to the bosses 41 is formed inside of the case C.

In particular, the slide plate 8 is stored within the connector 2 in such a manner that it can be freely moved in a direction perpendicular to the insertion and removal direction of the electronic equipment 1. The boss 41 is projected from the upper and lower faces of the right end portion 8*b* of the slide plate 8, respectively. The slide plate 8 includes a cam groove 9 which corresponds to the fitting projection 7' of the mating connector 3.

The case C includes a connector mounting opening 22 and a connector introduction passage 52. On an inner face of the right side wall of the case C, there is formed a slide groove 51 which corresponds to the bosses 41 of the slide plate 8. And in a bottom face 52*a* of the connector introduction opening 52 into which the mating connector 3 is introduced, there are formed a pair of guide grooves 6'.

The slide groove 51 includes a fitting side wall 51*a* and a removal side wall 51*b* for the boss 41 (see FIG. 10). A start end portion 53*a* and a terminal end portion 53*c* of the slide groove 51 are formed almost in parallel to each other, and an intermediate portion 53*b* of the slide groove 51 is formed in an inclined manner. The start end portion 53*a* is arranged slightly outside the terminal end portion 53*c*.

The other connector 3 includes a fitting projection 7' engaging with the cam groove 9 and a pair of slide projection strips 5' (see FIG. 5) in the bottom face thereof which engages with the guide grooves 6'. By the way, when the slide plate 8 is disposed in the upper portion of the connector 2, then the fitting projection 7' (which corresponds to numeral 7 in FIG. 1) is disposed in the upper portion of the mating connector 3 so as to correspond to the position of the slide plate 8 (see FIG. 1).

Next, description will be given below of a process in which the connector 2 is fitted with the mating connector 3.

As shown in FIG. 9 (*a*), the mating connector 3 is inserted from a mating connector side entrance 22*b* of the connector mounting opening 22 of the case C and is disposed in the connector introduction passage 52 while the slide projection strips 5' are engaged with the guide grooves 6'. Then, the mating connector 3 is moved along the guide grooves 6' up to the leading end of the start end portion 53*a* of the slide groove 51. At the then time, the mating connector 3 is held in a state in which it waits for fitting with the connector 2. The slide plate 8, which has been previously inserted into the connector 2, is set such that the bosses 41 are met with the start end portion 53*a* of the slide groove 51 in the case C.

In this state, if the electronic equipment 1 is pushed into the case C, then the fitting projection 7' of the mating connector 3 can be engaged with the cam groove 9 of the slide plate 8. And, if the electronic equipment 1 is pushed in further, then, as shown in FIG. 9 (*b*), while the mating connector 3 is retreating, the fitting projection 7' advances within the cam groove 9, which causes the bosses 41 to slide along the fitting side wall 51*a* of the slide groove 51. As shown in FIG. 9 (*c*), if the bosses 41 reach the terminal end portion 53*c* of the fitting side wall 51*a*, then the right end portion 8*b* of the slide plate 8 is stored into the inside of the connector 2 and, at the same time, the left end portion 8*a* of the slide plate 8 is projected out externally of the connector 2. If the left end portion 8*a* of the slide plate 8 is exposed to the outside, then the mating connector 3 retreats up to the entrance side 22*b* along the guide grooves 6' and also the fitting projection 7' reaches the terminal end 9*b* of the cam groove 9. This completes the fitting engagement between the connector 2 and the mating connector 3.

Now, description will be given below of an operation to remove the fitting engagement between the connector 2 and the mating connector 3.

In the state shown in FIG. 9 (*c*), if the electronic equipment 1 is pulled out from the case C, then, as shown in FIG. 9 (*b*), while the mating connector 3 is advancing along the guide grooves 6', the fitting projection 7' is moved from the terminal end 9*b* of the cam groove 9 toward the start end 9*a* thereof. At the same time, the bosses 41 are slid on the removal side wall 51*b* of the slide groove 51 and the right end portion 8*b* of the slide plate 8 is projected out from the connector 2. Further, if the electronic equipment 1 is pulled out up to the exit side 22*a* of the case C, then the right end portion 8*b* of the slide plate 8 is exposed out from the connector 2 and, at the same time, the engagement between the fitting projection 7' and cam groove 9 is removed (see FIG. 9 (*a*)). This completes removal of the fitting engagement between the two connectors 2 and 3.

In the fifth embodiment, the engagement and removal between the connector 2 and the mating connector 3 is executed by means of sliding motion between the bosses 41 projectingly provided on the right end portion 8*b* of the slide plate 8 and the slide groove 51 formed within the case C. Accordingly, when compared with the structure in which the fitting inclined wall 16 and removal inclined wall 17 (see FIG. 4) that correspond to the slide plate 8 including no bosses 41 are formed on the two sides of the case C, since the slide groove 51 may be formed only on one side of the case C, the size thereof can be reduced.

In particular, in the above-mentioned comparison structure, to form the fitting inclined wall 16 and removal inclined wall 17 (see FIG. 4), the two sides of the case C must be respectively formed longer by a distance L (see FIG. 4), that is, the case C must be formed longer by a total of 2 L. On the other hand, in the fifth embodiment, only one side of the case C may be formed longer by a distance L' (see FIG. 9 (*a*)). Here, since there is found a relation $L<L'<2L$, the size of the case C itself can be reduced. Accordingly, the connector 2 (or the mating connector 3) to be disposed in a car (not shown) can be placed efficiently at a desired installation position, thereby being able to enhance the general-purpose property of the connector 2 (or the mating connector 3).

Figure 11:
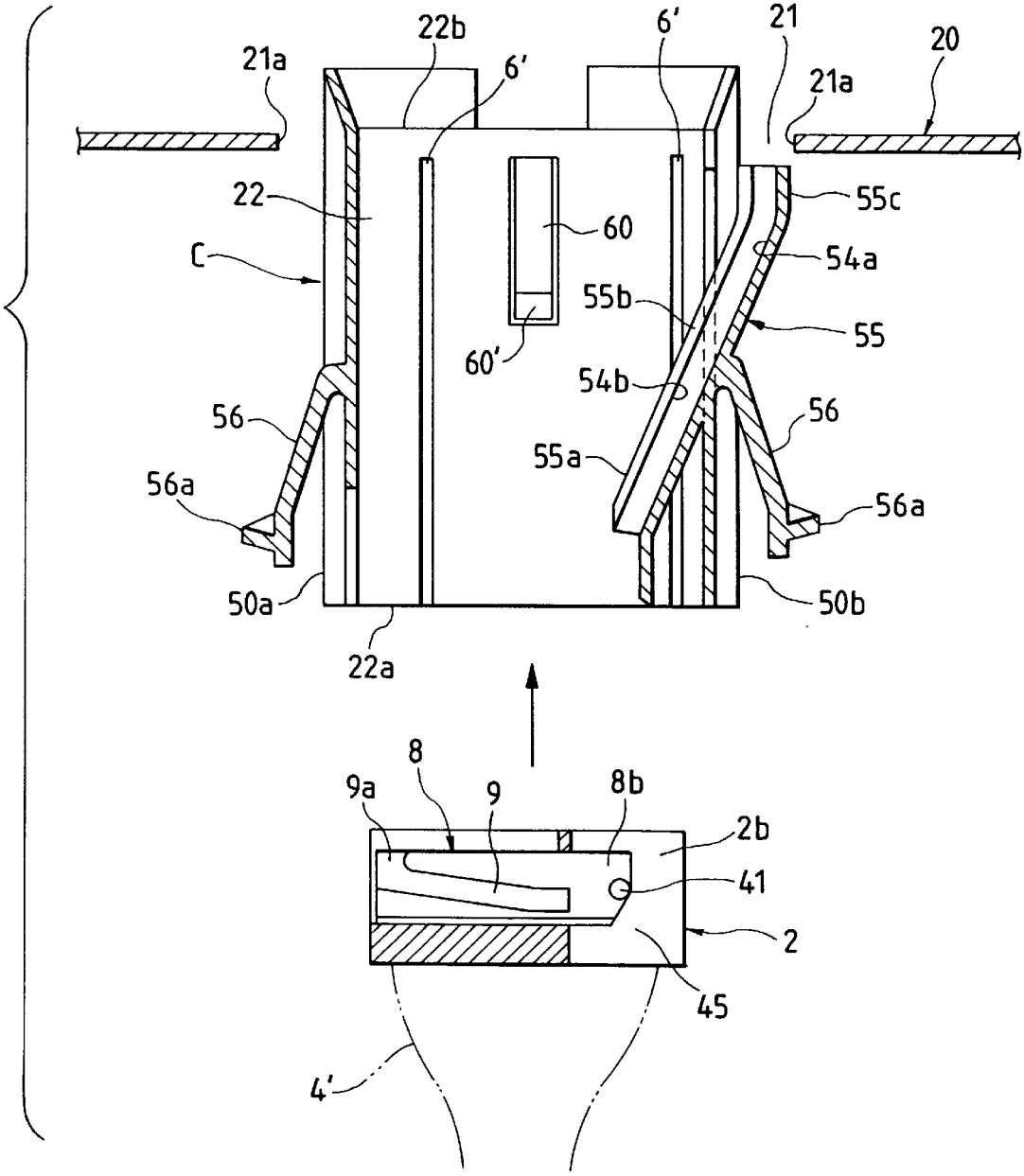
FIG. 11 is an exploded perspective view of a sixth embodiment of a connector coupling device according to the present invention.
Figure 12:
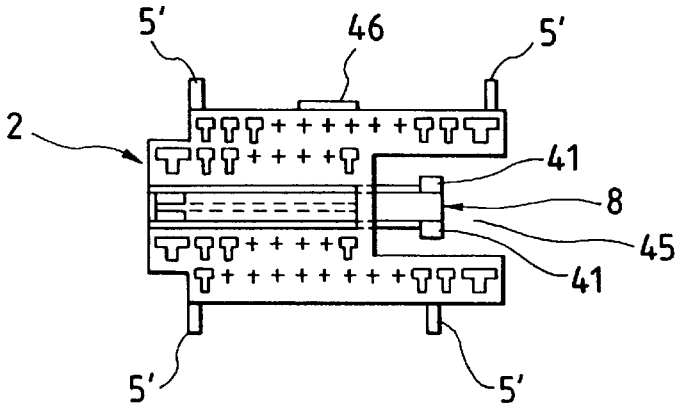
FIG. 12 is a front view of one connector shown in FIG. 11.
Figure 13:
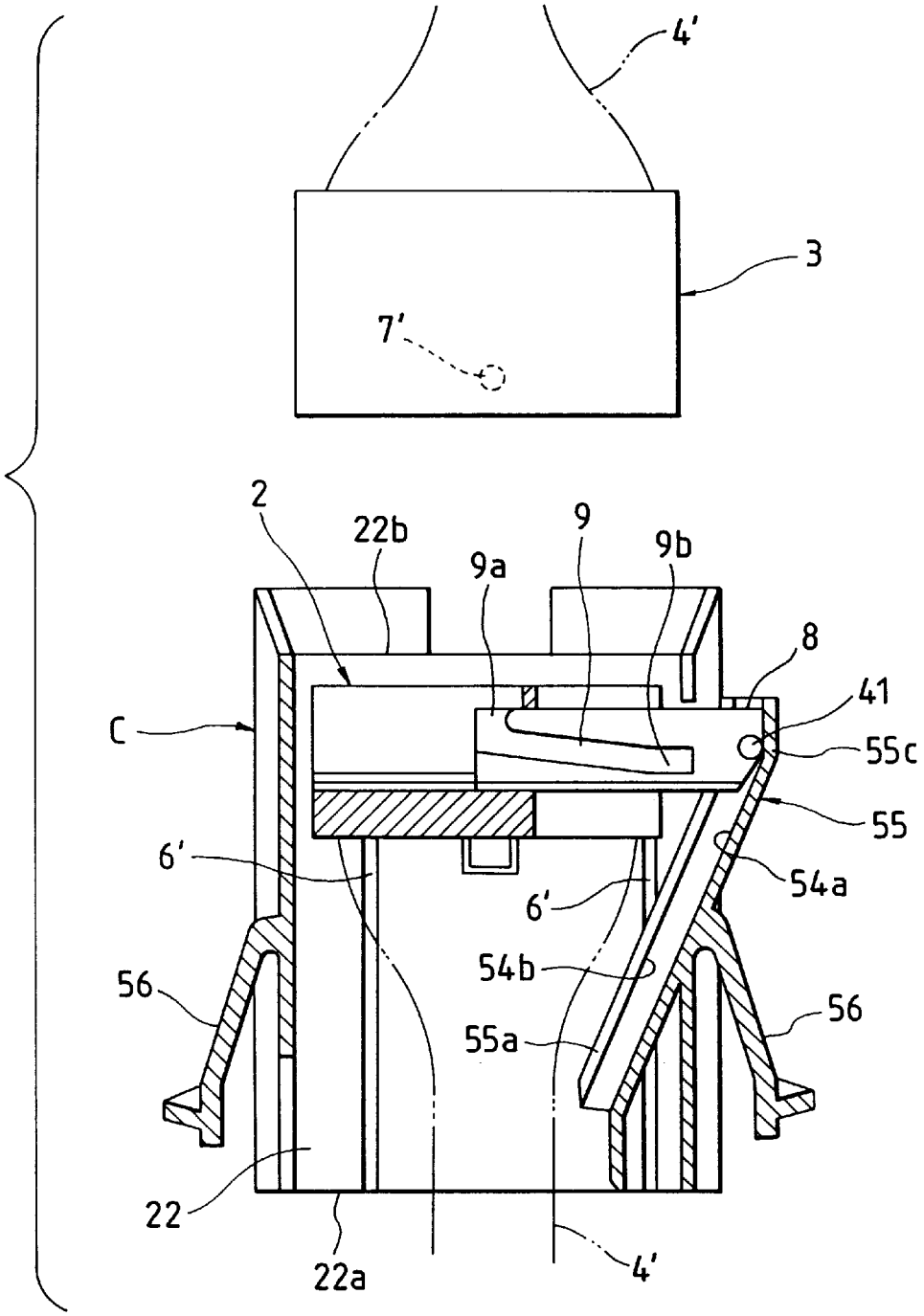
FIG. 13 is an explanatory view of the operation of the connector coupling device shown in FIG. 11.

Now, FIGS. 11 to 13 are respectively explanatory views of the structure and connector coupling process of a sixth embodiment of a connector coupling device according to the present invention. The same components thereof as those employed in the first to fourth embodiments are given the same designations and numerals and thus the detailed description thereof is omitted here.

In the fourth embodiment, prior to fitting engagement between the two connectors 2 and 3, the right end portion 8*b* of the slide plate 8 is projected out externally of the connector 2. On the other hand, in the sixth embodiment, prior to fitting engagement between the two connectors 2 and 3, the right end portion 8*b* of the slide plate 8 is situated within the connector 2.

In FIG. 11, referring to the structure of the present connector coupling device, there is formed in the right end portion 2*b* of the connector 2 a recessed portion 45 which extends through the right end portion 2*b* in the engaging and removal direction and has a U-shaped section. The slide plate 8 is stored within the connector 2 so as to be able to slide freely within the recessed portion 45. Further, a pair of slide projection strips 5' are provided in each of the upper and lower portions of the connector 2. On the other hand, in the case C, there is provided a slide rail 55 which allows the bosses 41 of the slide plate 8 to slide therealong.

As shown in FIG. 11, the boss 41 is provided on each of upper and lower faces of the right end portion 8*b* in the slide plate 8. A cam groove 9 is formed so as to be engaged with the fitting projection 7' of the mating connector 3.

On the other hand, in the case C, two securing arms 56 are respectively provided on the two side walls 50*a* and 50*b* of the case C, a pair of guide grooves 6' are formed respectively inside the two side walls 50*a* and 50*b*, and the slide rail 55 is disposed in such a manner that it crosses the right side wall 50*b*. By the way, the securing arms 56 may also be provided on the upper and lower walls of the case C instead of providing the securing arms 56 on the two side walls 50*a* and 50*b*. The two securing arms 56 respectively include securing pieces 56*a* which can be hitched on the opening edges 21*a* of the equipment mounting opening 21 of the instrument panel 20. This makes it possible to prevent the case C from being removed from the instrument panel 20.

The slide rail 55 is structured in the following manner. A start end portion 55*a* thereof is disposed in the inside of the case C, a terminal end portion 55*c* thereof is projected out externally of the case C, and an intermediate portion 55*b* thereof crosses the right side wall 50*b* of the case C. The slide rail 55 includes a fitting side wall 54*a* and a removal side wall 54*b* which respectively correspond to the bosses 41 of the slide plate 8. In particular, when bringing the two connectors 2 and 3 into engagement with each other, the bosses 41 are slid along the fitting side wall 54*a*, and when removing the engagement between them, the bosses 41 are slid along the removal side wall 54*b*.

Next, description will be given below of a process of bringing the two connectors 2 and 3 into engagement with each other. By the way, in the present embodiment, description will be given of a case in which the connector 2 is connected to the terminal of the wire harness 4. However, the present description can also apply to other cases substantially in the same manner.

As shown in FIG. 11, in order that the connector 2 with the slide plate 8 previously stored therein is disposed in a connector side entrance 22*a* of the connector mounting opening 22 of the case C, as shown in FIG. 12, the slide plate 8 is situated within the connector 2. In this state, since the slide plate 8 is not projected externally of the connector 2, the slide plate 8 can be protected. This eliminates a fear that the slide plate 8 and the connector 2 can be broken when they are delivered, thereby being able to enhance the reliability of the quality of the slide plate 8 and the connector 2. Also, this makes it possible to reduce the size of the connector 2 in which the slide plate 8 is stored.

The slide projection strips 5' of the connector 2 are engaged with the guide grooves 6' of the case C, thereby bringing the bosses 41 of the slide plate 8 into engagement with the start end portion 55*a* of the slide rail 55. Then, as shown in FIG. 13, the connector 2 is pushed along the guide grooves 6' into the deep portion of the case C. As the connector 2 is pushed in, the bosses 41 are slid on the removal side wall 54*b* of the slide rail 55, so that the slide plate 8 is gradually pulled out. If the bosses 41 reach the terminal end portion 55*c* of the slide rail 55, then the slide plate 8 is pulled out most and, at the then time, the start end 9*a* of the cam groove 9 of the slide plate 8 is situated almost in the center of the connector 2. And, a provisional securing piece 46 disposed in the connector 2 is provisionally secured to a provisional securing pawl 60 disposed in an elastic arm 60 which is provided in the case C. This state is a wait state occurring when the two connectors 2 and 3 are to be fittingly engaged with each other.

After then, if the fitting projection 7' of the mating connector 3 is engaged with the cam groove 9 and the mating connector 3 is pushed toward the connector 2, then the connector 2 retreats and also the bosses 41 are slid on the fitting side wall 54*a* of the slide rail 55, so that the slide plate 8 is gradually pulled back. Due to this, the fitting projection 7' is pulled into the cam groove 9. If the bosses 41 arrive at the start end portion 55*a* of the slide rail 55, then the fitting projection 7' reaches the terminal end 9*b* of the cam groove 9. At the then time, the fitting engagement between the two connectors 2 and 3 is completed.

Next, description will be given below of an operation to remove the two connectors 2 and 3 which are engaged with each other.

If the connector 2 is pushed along the guide grooves 6' toward the mating connector 3, then the bosses 41 of the slide plate 8 are slid on the removal side wall 54*b* of the slide rail 55. As a result of this, the slide plate 8 is pulled out from within the connector 2 and the cam groove 9 is also moved. Due to the movement of the cam groove 9, the fitting projection 7' within the cam groove 9 is gradually moved, so that the fitting engagement between the connector 2 and the mating connector 3 is gradually removed. If the bosses 41 arrive at the terminal end portion 55*c* of the slide rail 55, then the fitting projection 7' is situated at the start end 9*a* of the cam groove 9, so that the fitting projection 7' and cam groove 9 are engaged with each other. In this state, if the mating connector 3 is gripped by hand and the fitting projection 7' is taken out from the start end 9*a* of the cam groove 9, then the removal of the engagement between the connector 2 and the mating connector 3 can be completed.

Figure 14:
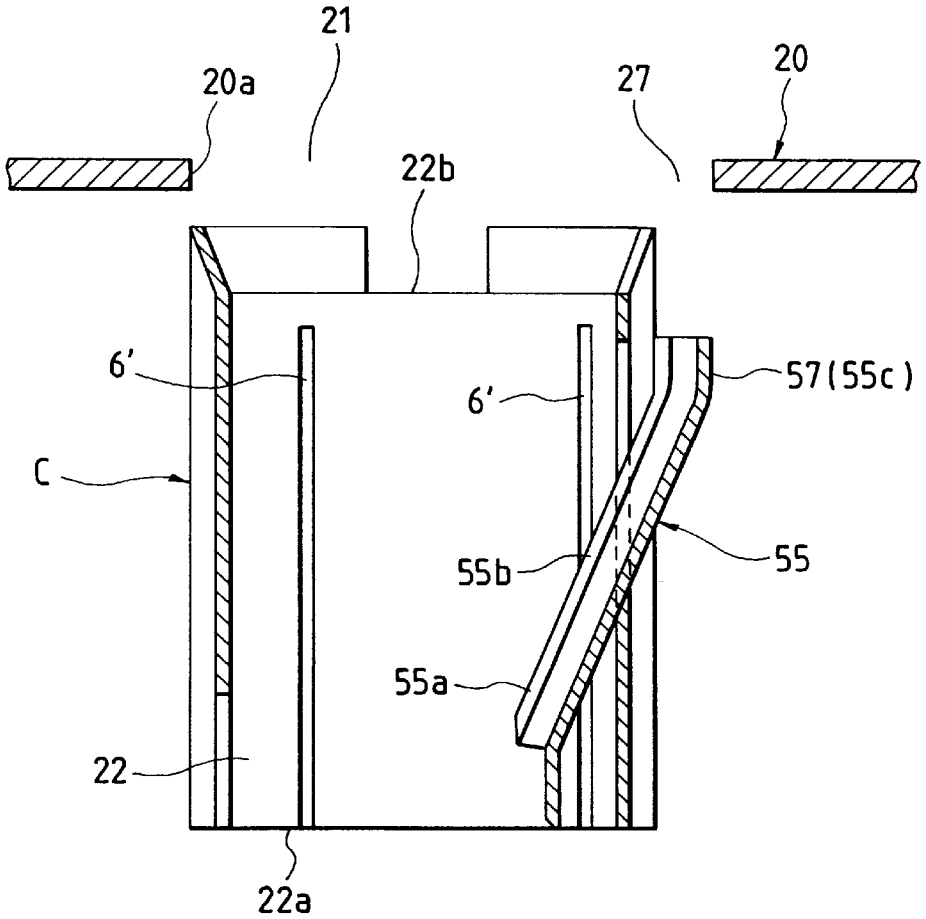
FIG. 14 is a view of an another example of a case shown in FIG. 11.
Figure 15:
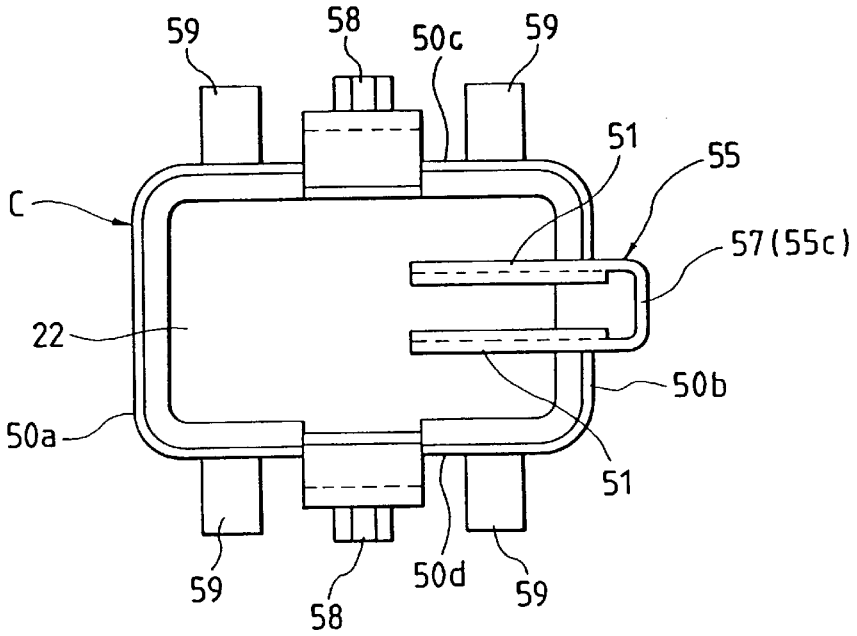
FIG. 15 is a front view of the case shown in FIG. 14.
Figure 16:
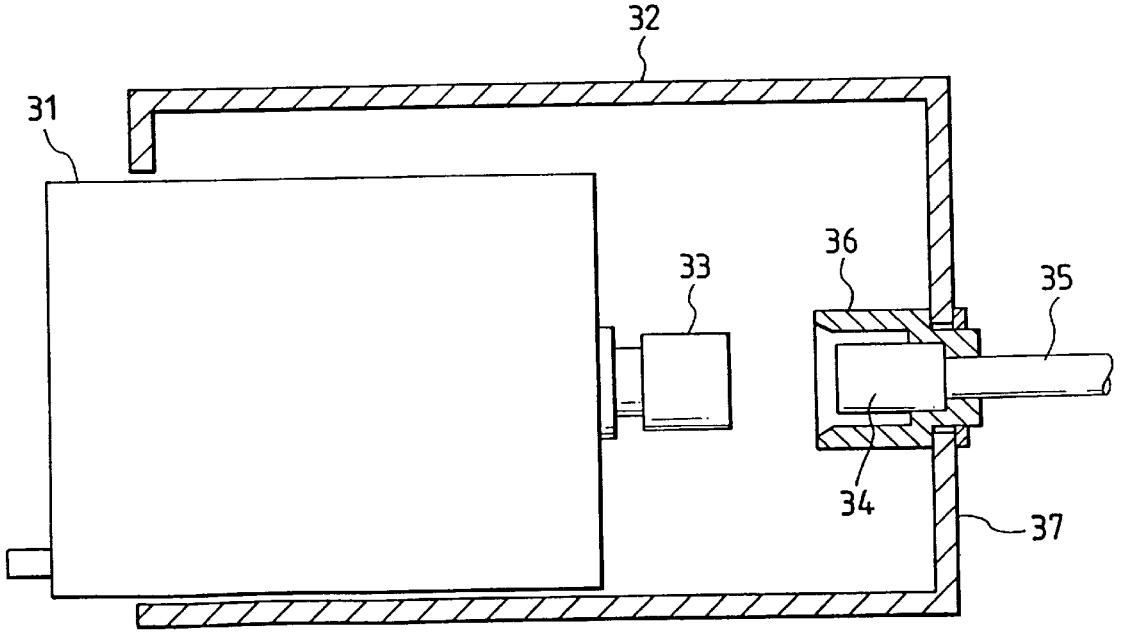
FIG. 16 PRIOR ART
FIG. 16 is an explanatory view of a conventional connector coupling device.
Figure 17:
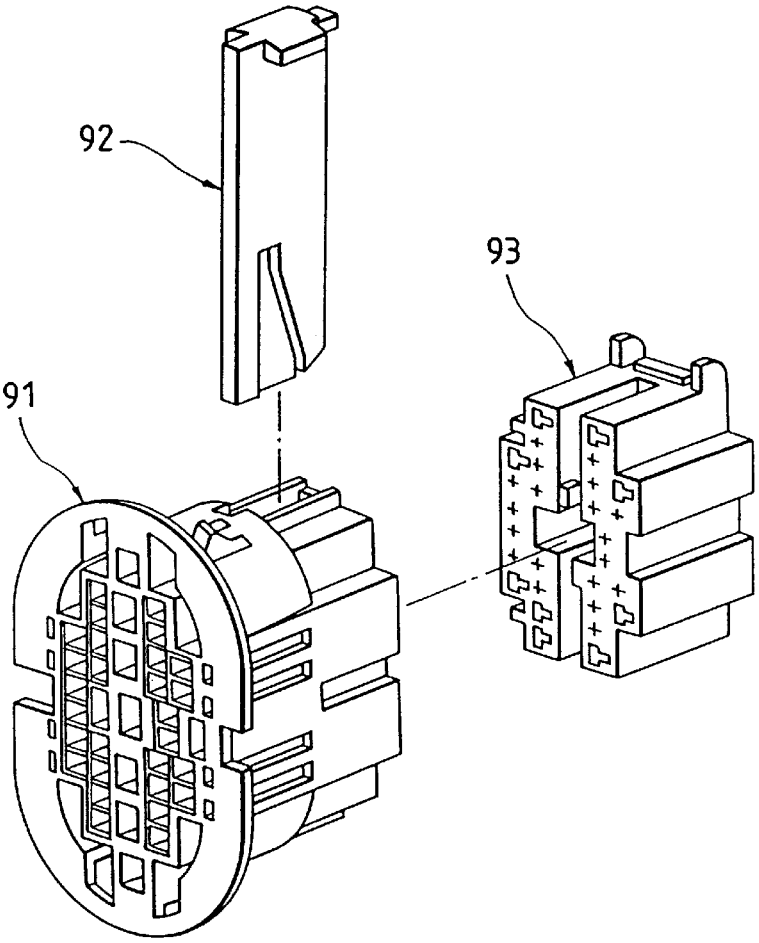
FIG. 17 PRIOR ART
FIG. 17 is an explanatory view of another conventional connector coupling device; and, FIG. 18 is a view of a state in which a slide plate is inserted into one connector shown in FIG. 17.
Figure 18:
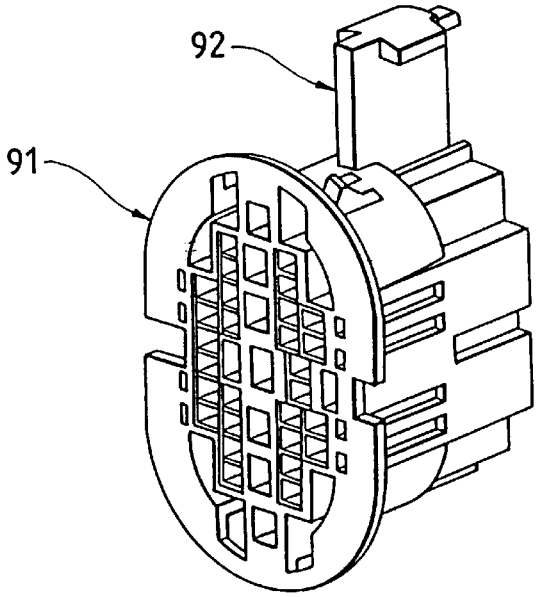
FIG. 18 PRIOR ART

Now, in FIGS. 14 and 15, there is shown one application example of the case which is used in the sixth embodiment of the invention.

In the applied case, as shown in FIG. 14, the terminal end portion 55*c* of the slide rail 55 projected out externally of the case C is used as a wrong coupling prevention member 57. That is, in the equipment mounting opening 21 of the instrument panel 20 for fixing the case C, there is formed a coupling detection hole 27 which corresponds to the wrong coupling prevention member 57. Also, as shown in FIG. 15, two engaging arms 58 are respectively erected on the upper and lower walls 50*c* and 50*d* of the case C, while a pair of stoppers 59 are projectingly provided respectively on the both sides of each engaging arm 58. By the way, in each engaging arm 58, there is provided a securing piece (not shown).

With use of this structure, when mounting the case C onto the equipment mounting opening 21 of the instrument panel 20, if the wrong coupling prevention member 57 cannot be fitted into the coupling detection hole 27, then it is possible to detect that the case C is not situated at a proper position with respect to the equipment mounting opening 21. Also, if the wrong coupling prevention member 57 can be fitted into the coupling detection hole 27, then it is possible to judge at a glance that the case C is situated at a proper position with respect to the equipment mounting opening 21. At the then time, since the opening edge 20*a* of the equipment mounting opening 21 is held by and between the securing pieces of the engaging arms 58 and their corresponding stoppers 59, the case C can be retained in the equipment mounting opening 21.

As described above, even though the wrong coupling prevention member 57 is not provided as a new separate member in the case C, if the terminal end portion 55*c* of the slide rail 55 projected out externally of the case C is substituted for the wrong coupling prevention member 57, the case C itself can be formed in a compact and simple shape.

As has been described heretofore, there can obtained the following effects.

According to the present invention, if the electronic equipment is inserted into the case, then the slide plate mounted on one connector is pushed against the fitting inclined wall and is thereby slid thereon and, due to the sliding motion of the slide plate, the fitting projection of the other connector is pulled in along the cam groove of the slide plate toward the electronic equipment side, so that the two connectors can be coupled together. This eliminates the possibility that the force used when mounting the electronic equipment can be applied directly to the case, which in turn avoids the need to increase the strength of the case itself specially. Thanks to this, not only the case or connectors can be prevented against breakage but also the two connectors can be fittingly engaged with each other accurately and smoothly.

According to the present invention, when the two connectors are fittingly engaged with each other, the confirmation projection is engaged with the recessed portion to thereby generate the engaging sound. That is, the thus generated engaging sound makes it possible to confirm that the two connectors are completely engaged with each other, which in turn can prevent the incomplete engagement between the two connectors.

According to the present invention, since the securing by the securing member of the case and electronic equipment is executed after the confirmation projection is engaged with the recessed portion, similarly to the above, it is possible to inform an operator of the completion of the connectors engagement, thereby preventing the half or incomplete connectors engagement.

According to the present invention, the slide plate includes a removal handle in the end portion thereof. Therefore, when removing the fitting engagement between the two connectors, while gripping the removal handle by hand, the slide plate can be pulled out easily, so that the fitting engagement between the two connectors can be removed.

According to the present invention, in the case, there is provided a removal inclined wall which, when removing the electronic equipment, allows the slide plate to slide in the opposite direction to the insertion direction of the electronic equipment; and, therefore, if the electronic equipment is pulled out from the case, then the engagement between the two connectors can be removed automatically.

According to the present invention, in the other connector, there are formed securing holes and, in the case, there are provided securing arms each including a securing projection engageable with its associated securing hole of the other connector, whereby, when the electronic equipment is held in a separated state, the other connector can be held by the case.

According to the present invention, in one connector, there is provided member such as a hood which, when one connector is inserted into the other connector, can press against the securing arm to spread the same by force. Thanks to this, the engagement of the securing projections of the securing arms with their associated securing holes can be easily remove, which makes it possible to turn the other connector easily from the fixedly held state thereof into the slidable state thereof.

According to the present invention, the slide plate itself is structured such that one end thereof is formed as a fitting inclined side and the other end thereof is formed as a removing inclined side to thereby form a parallelogram as a whole, while the respective sides of the slide plate are contacted with one edge or the other edge of the connector mounting opening when they are slid. Therefore, it is not necessary to provide the fitting and removal inclined walls in the interior portion of the case, which not only can simplify the interior structure of the case but also can reduce the size of the connector mounting opening (especially, the width of the slide plate in the sliding direction thereof). As a result of this, the whole of the connector coupling device can be reduced in size and weight.

According to the present invention, on the two side surfaces of one end portion of the slide plate, there are projectingly provided bosses and, in the case, there is formed a slide groove which corresponds to the bosses. And, the bosses are slid on the fitting side wall of the slide groove when bringing the two connectors into mutual engagement, whereas the bosses are slid on the removal side wall of the slide groove when removing the mutual engagement between these two connectors. That is, simply by forming a single slide groove in the case, the fitting and removal side walls corresponding to the bosses can be provided at the same time. Thanks to this, if the case itself is structured such that one end side of the case where the slide groove is situated is formed larger than the other end side of the case, then the slide groove can be formed positively. This can reduce the size of the case itself. And, the reduced size of the case makes it possible to use the limited installation space within a car with high efficiency.

According to the present invention, in one end portion of a connector housing, there is formed an insertion hole having a U-shaped section in such a manner that it extends through the present one end portion in the engaging (or removing) direction of the connectors, and the slide plate is stored within the connector housing in such a manner that it is free to advance into and retreat from the insertion hole. And, a slide rail corresponding to the bosses of the slide plate is provided in the case and the start end portion of the slide rail is disposed within the case, and the bosses of the slide plate are situated within the insertion hole before one connector is set within the case. Due to this, as the bosses are slid along the slide rail, the slide plate is moved to thereby be able to execute the engagement and removal between the two connectors. Further, in order to guide the bosses to the start end portion of the slide rail of the case, the bosses are situated within the insertion hole before the connector is set in the case. This eliminates the possibility that the slide plate can be projected out externally of the connector housing. Thanks to this, the slide plate can be prevented against damage during delivery of the connectors, so that the connector with the slide plate stored therein can be handled with no trouble. Still further, because the slide plate is not projected out externally of the connector housing, the connector housing can be made smaller in size.

According to the present invention, the terminal end portion of the slide rail is projected out externally of the case to thereby provide a wrong coupling prevention member and, in the equipment mounting opening of the case provided in an instrument panel, there is formed a coupling detection hole which corresponds to the wrong coupling prevention member. Therefore, unless the wrong coupling prevention member and coupling detection hole are opposed to each other, the case cannot be mounted to the equipment mounting opening. This makes it possible to correct the position of the case with respect to the equipment mounting opening, which in turn can prevent the wrong coupling between the case and the equipment mounting opening of the instrument panel.

Also, since the wrong coupling prevention member is formed of the terminal end portion of the slide rail projected out externally of the case, it is not necessary to provide a new separate member in the case, so that the case itself can be made compact in size and simple in shape. And, correspondingly to such compact and simple case, the connector and its mating connector can also be made compact in size.

What is claimed is:

1. A connector coupling device comprising:

a first connector in which a slide plate having a cam groove is provided being capable of sliding so as to traverse the first connector;

a second connector having a fitting projection engageable with the cam groove for coupling the second connector with the first connector when the slide plate is slid toward a first direction, and removable from the cam groove for removing the second connector from the first connector when the slide plate is slid toward a second direction opposed to the first direction;

a coupling case having a first opening into which the first connector is inserted and a second opening into which the second connector is inserted and slidably mounted therein;

a fitting support member urging one end portion of the slide plate toward the first direction while the first connector is pushed toward the second connector inside of the case in a third direction perpendicular to the first and second directions for coupling the first connector with the second connector; and a removal support member for urging the slide plate toward the second direction while the first connector is pulled from the second connector inside of the coupling case in a fourth direction opposed to the third direction for removing the first connector from the second connector, wherein the coupling case includes a slide groove provided on one of side walls, the slide groove extending in the third and fourth directions and being curved toward the second direction, the slide plate includes a protrusion for engaging with the slide groove, the fitting support member is an outer side wall of the slide groove for abutting against the protrusion of the slide plate while the second connector is pushed toward the fourth direction, the removal support member is an inner side wall of the slide groove for abutting against the protrusion of the slide plate while the second connector is pulled toward the third direction, the first connector includes a grooved portion, extending in a direction perpendicular to the sliding direction of the slide plate through the first connector, and having a substantially U-shape, the slide groove is formed so as to cross the one side wall of the coupling case from inside to outside thereof, and the grooved portion of the first connector is capable of accommodating the slide plate and that portion of the fitting groove disposed inside of the coupling case.

2. The connector coupling device as set forth in claim 1, wherein that portion of the fitting groove exposed to outside of the coupling case is a detection member for detecting a wrong coupling of the coupling case and an exterior equipment.

3. A connector coupling device comprising:

a first connector in which a slide plate having a cam groove is provided being capable of sliding so as to traverse the first connector;

a second connector having a fitting projection engageable with the cam groove for coupling the second connector with the first connector when the slide plate is slid toward a first direction, and removable from the cam groove for removing the second connector from the first connector when the slide plate is slid toward a second direction opposed to the first direction;

a coupling case having a first opening into which the first connector is inserted and a second opening into which the second connector is inserted and slidably mounted therein, the coupling case including a provisional retaining member for provisionally retaining the second connector when the first connector is separated from the second connector wherein the provisional retaining member comprises an elastic arm having a protrusion engaging provisionally with a recess formed on the second connector, the protrusion is positioned at a start point of the coupling of the first connector and the second connector; and a fitting support member urging one end portion of the slide plate toward the first direction while the first connector is pushed toward the second connector inside of the case in a third direction perpendicular to the first and second directions for coupling the first connector with the second connector, wherein a front end of the first connector spreads the elastic arm outwards to release the provisional retaining of the second connector when the first connector is pushed toward the third direction to couple with the second connector.

* * * * *